US009631305B2

(12) United States Patent
Brunner et al.

(10) Patent No.: US 9,631,305 B2
(45) Date of Patent: Apr. 25, 2017

(54) DEVICE AND METHOD FOR INFLUENCING THE POSITION OF KNOTS BETWEEN THE UPPER THREAD AND THE LOWER THREAD WHEN SEWING WITH A SEWING MACHINE

(71) Applicant: BERNINA International AG, Steckborn (CH)

(72) Inventors: Severin Brunner, Steckborn (CH); Alain Capt, Rickenbach Sulz (CH); Gunnar Schlaich, Constance (DE)

(73) Assignee: BERNINA International AG, Steckborn (CH)

( * ) Notice: Subject to any disclaimer, the term of this patent is extended or adjusted under 35 U.S.C. 154(b) by 10 days.

(21) Appl. No.: 14/711,925

(22) Filed: May 14, 2015

(65) Prior Publication Data

US 2015/0330005 A1 Nov. 19, 2015

(30) Foreign Application Priority Data

May 16, 2014 (CH) ..... 0750/14

(51) Int. Cl.

| | |
|---|---|
| ***D05B 19/12*** | (2006.01) |
| ***D05B 47/04*** | (2006.01) |
| ***D05B 63/00*** | (2006.01) |
| ***D05B 49/00*** | (2006.01) |

(52) U.S. Cl.

CPC ..... *D05B 19/12* (2013.01); *D05B 47/04* (2013.01); *D05B 49/00* (2013.01); *D05B 63/00* (2013.01)

(58) Field of Classification Search

CPC ..... D05B 47/00; D05B 47/02; D05B 47/04; D05B 57/08; D05B 63/00; D05B 19/12; D05B 49/00

See application file for complete search history.

(56) References Cited

U.S. PATENT DOCUMENTS

| | | | | | |
|---|---|---|---|---|---|
| 4,340,003 | A * | 7/1982 | Hanyu | D05B 63/00 | 112/184 |
| 4,690,083 | A * | 9/1987 | Hara | D05B 45/00 | 112/254 |
| 4,702,185 | A * | 10/1987 | Hanyu | D05B 47/04 | 112/254 |
| 4,892,048 | A * | 1/1990 | Karuga | D05B 47/04 | 112/254 |
| 5,042,408 | A * | 8/1991 | Suzuki | D05B 47/04 | 112/254 |
| 2004/0173132 | A1* | 9/2004 | Enns | D05B 47/04 | 112/470.01 |
| 2016/0153129 | A1* | 6/2016 | Takizawa | D05C 7/00 | 112/102.5 |

FOREIGN PATENT DOCUMENTS

| | | |
|---|---|---|
| DE | 10304780 | 11/2003 |

* cited by examiner

*Primary Examiner* — Ismael Izaguirre

(74) *Attorney, Agent, or Firm* — Volpe and Koenig, P.C.

(57) ABSTRACT

A device and the method for influencing the position of the knot (31) between the upper thread (23) and the lower thread (17) when sewing with a sewing machine (1) using a computer (37), which calculates for every sewing stitch to be formed a control value for an actuator (39), by which a braking force of the thread tension regulator (23) is controlled.

9 Claims, 3 Drawing Sheets

DEVICE AND METHOD FOR INFLUENCING THE POSITION OF KNOTS BETWEEN THE UPPER THREAD AND THE LOWER THREAD WHEN SEWING WITH A SEWING MACHINE

INCORPORATION BY REFERENCE

The following documents are incorporated herein by reference as if fully set forth: Swiss Patent Application No. 00750/14, filed May 16, 2014.

BACKGROUND

The invention relates to a device and a method for influencing the position of knots between the upper thread and the lower thread when sewing with a sewing machine.

When sewing a material and/or a textile or non-textile planar formation with a sewing machine the upper thread and the lower thread are connected to each other and/or interlooped or knotted at every point the sewing needle pierces the material. The term "sewing machine" here comprises particularly household sewing machines and overlock sewing machines. The position of every knot and/or every connection site of the upper thread and the lower thread in reference to the respectively allocated piercing site in the material is dependent on the thread tensions of the upper thread and the lower thread and/or their temporal progression during the knot formation. This particularly relates to the last phase of the knot formation, with the upper thread being stressed in the last section of the upwards motion of the sewing needle by a thread lever, which is arranged between the sewing needle and a thread tension regulator. The thread tension regulator generally comprises two thread tension disks, which can be compressed against each other with an adjustable force, with the upper thread being guided therebetween. By the increased thread tension of the upper thread, on the one hand, the knot is tightened and, on the other hand, a defined quantity of the upper thread is pulled off the bobbin. When the thread tension and/or the tensile force of the upper thread changes in reference to the one of the lower thread or vice versa, the position of the knot also changes at the respective piercing site in reference to a neutral central position within the material. The greater the tension of the upper thread the farther away is the location of the knot from the central position in the direction of the top of the material. Inversely, the knot can be pulled towards the bottom of the material by reducing the tension of the upper tread in an analogous fashion, or can even come to rest at the bottom of the material and be displaced towards the adjacent piercing site of the sewing needle.

It is known to manually set a suitable compression force at the thread tension regulator using adjustment elements at the sewing machine, which force adjusted to the respective friction coefficient of the thread used in reference to the surface of the thread tension disks, so that the knots are pulled to the center of the material to the extent possible, at least when sewing in straight stitches and/or without any zigzag motions of the needle bar.

A thread tension regulator is known from DE10304780, in which the thread tensioning device and/or the pressure applied by the thread tensioning device upon the thread is adjustable via an electromagnet perpendicular in reference to the pressure applied. Via an operating device the target value may be predetermined for the desired pressure. The relationship between the driving current of the electromagnet and the resulting pressure is known from a reference sewing machine. This relationship and/or function may however deviate from the known reference relationship in other sewing machines. Accordingly, a correction value is determined and saved for every sewing machine, by which either the predetermined target value for the pressure of the thread tension regulator or the value of the driving current for the electromagnet can be corrected such that the resulting pressure of the thread tension regulator is equivalent to the target value set, independent from the respective sewing machine.

Due to the fact that the actual position of the knot during the sewing process is generally dependent on at least one or more parameters, such as type and thickness of the material, friction coefficient, and the tension of the lower thread as well as the upper thread, type of knot, pivotal position of the needle bar, length and width of the stitch, and/or amount, direction, and speed of the change of the stitching position between successive sewing stitches, type of sewing machine, environmental conditions, such as humidity and temperature and the like, the results of a fixed predetermined setting of the thread tension regulator is frequently not satisfactory. Particularly in case of zigzag or buttonhole seams, the dependency of the insertion of the knot from the pivotal position of the needle bar may lead to the knots being pulled on one side optimally into the center of the material at the piercing sites, however those on the other side are not.

SUMMARY

One objective of the present invention is to provide a device and a method for a sewing machine, by which the position of the knot can be easily influenced and/or controlled when executing one or more successive sewing stitches.

This objective is attained in a device and a method for influencing the position of knots between the upper thread and the lower thread when sewing a planar formation with a sewing machine according to one or more features of the invention.

The device comprises a thread tension regulator with an actuator, which is in an effective connection to the upper thread or the lower thread, and which is embodied to influence the tensile or tightening force acting upon the respective thread, at least during the formation of knots. The actuator is preferably embodied for directly influencing and/or controlling a braking power when the knots are tightened. Alternatively, the braking force may also be indirectly influenced and/or controlled during the tightening of the knots, by here influencing and/or controlling the length of a section of the upper thread and/or the lower thread available for forming the knots. In particular, the actuator for conveying the thread may be embodied in the same direction as the thread direction and/or opposite thereto.

The force resulting, which the upper thread and the lower thread apply upon the knot during the formation thereof, is preferably influenced and/or controlled by only one actuator, which optionally affects the upper thread or the lower thread. This allows a simple and space-saving design. The control of a single actuator is easier compared to two or more actuators, which act both upon the lower thread as well as the upper thread.

The guiding value for the actuator may be individually predetermined by the control of the sewing machine a) for each of the sewing stitches to be formed or b) for every defined group of successive sewing stitches to be formed. The control comprises a computer, which is embodied a) for each sewing stitch and/or b) for every defined group of successive sewing stitches to process at least one predetermined or predeterminable reference value for the guide parameter of the actuator together with at least one parameter influencing the position of the knot during the sewing process in order to form a guide parameter for the actuator such, that a) the deviation of the position of the knots from a predetermined or predeterminable target position is as low as possible and/or b) the average deviation of the position of the knots in each group of knots from a predetermined or predeterminable target position is as low as possible. The target position for each knot relates to a reference position at the corresponding piercing site in the material. This reference position is preferably located in the middle between the two surfaces of the planar formation to be sewn. With regards to the reference position the target position of each knot comprises a component in the piercing direction of the sewing needle and/or perpendicular or orthogonally to the planar formation and a component parallel to the bottom and/or top surface of the planar formation. The direction parallel in reference to the surface comprises a component in the direction of the next following and/or a component in the direction of the directly previous piercing site and thus by the feed component of the material in the sewing direction and a pivotal component of the sewing needle perpendicular to the sewing direction, relative to the subsequent and/or previous sewing stitch. The target position of a knot may at least approximately be predetermined by a positive or negative length measurement, which represents the length of the thread between the reference point and the desired knot position, with the algebraic sign indicating if the knot is located above or below the reference point.

The processing instructions saved in the computer are based on information concerning the fact how one or more parameters or changes of such parameters affect the position of the knots, and what correction of the guide parameter is necessary that during sewing a) the deviation of the position of each knot from the corresponding target position is minimal and/or b) in groups of sewing stitches the average deviation of the knot position from the corresponding target positions is minimal.

The processing instructions may be predetermined such that every knot is pulled into the material as closely as possible to the corresponding neutral central position. Alternatively, it is also possible to predetermine the knot positions for every sewing stitch or for every group of sewing stitches deviating from the respective neutral central position. Such deviations may be predetermined, e.g., within a group of several sewing stitches, for every stitch individually or by way of a function. In particular, when sewing a zigzag seam knots are formed between successive piercing sites in different positions with regards to the respective piercing site at the top or the bottom of the material. If the upper thread and the lower thread show different colors, this way, visible patterns can be generated.

In a preferred exemplary embodiment of the invention the control of the sewing machine can limit the sewing speed depending on the adjustment period required by the actuator. This way it can be ensured that the periods between executing successive sewing stitches are always sufficiently long to completely adjust via the actuator the control parameters and/or the braking force of the thread tension regulator to the desired value in order to influence the thread tension for every sewing stitch, at least during the knot formation.

Alternatively, the sewing machine control, particularly in case of greater sewing speeds, can temporarily correct the values of the guiding parameters for the actor such that the adjustment periods are shorter or maximally equivalent to the respective stitch periods. This way, the precision of the stitch insertion can be reduced within a tolerable range in favor of a higher maximum sewing speed.

Another option is given in that successive sewing stitches are combined to groups and for each of these groups a common guide value is determined, for example such that the average deviation of the common guide value from the optimal guide values is minimal in every group. In this case, the adjustment parameter of the actuator needs to be changed less frequently. In this case, too, the maximally possible sewing speed is increased on expense of the precision of the knot position.

In another advantageous embodiment of the invention the sewing machine may comprise one or more sensors for detecting the tension of the upper thread and/or the tension of the lower thread or for detecting equivalent measurements. Here, preferably only the maximum tension value during the insertion of the knot and/or generally a tension value representative for the knot insertion is further processed.

The measurements of such sensors can be used in an initialization process of the sewing machine to determine one or more reference values and/or parameters, which characterize the influence of the values of one or more parameters upon the position of the knots. The measurements of these sensors are not used for real-time setting of the thread tension to a predetermined value, though.

Alternatively, sensors of an external measuring device and/or one embodied outside the sewing machine may be used for such initialization processes. The reference values typical for the sewing machine are saved in the memory of the sewing machine in a non-volatile fashion.

The calculation of a guide value for the actuator occurs respectively based on at least one saved or adjustable reference value. It is influenced in a computer of the control together with at least one additional parameter, which influences the knot position during the sewing process, in order to further process it into a guide value for the actuator.

Here an example: A guide value serves as the reference value for the actuator, which during the sewing process of a planar formation causes, under predetermined and/or predeterminable reference conditions, that the knots at the respective piercing sites of the sewing needle are pulled into a reference position in the middle between the top and the bottom of the planar formation. In the following, an example for such reference conditions: linear seam with a medium reference stitch length with a reference thread on a reference material at a predetermined reference sewing speed and at a central pivotal reference position of the needle bar.

For example, a parameter influencing the knot position during the sewing process is the change of the pivotal position of the needle bar in reference to the previous sewing stitch and/or the amount and direction of the position of the piercing site in reference to the previous piercing site. A correction function is saved in a memory of the control in a suitable fashion. Depending on the change of the pivotal position of the needle bar in reference to the pivotal position at the previous piercing site this correction function provides a correction value for the guide parameter and/or for the reference value. By adding the corrective value to the reference value and/or generally by processing the reference value in consideration of the corrective value a corrected guide parameter is calculated. The application of the guide parameter for the actuator corrected in this fashion during the formation of the sewing stitch causes that the deviation of the knot position from the neutral central position is minimal at this piercing site.

Alternatively, the processing instructions of the computer of the control may also consider other or additional parameters, which influence the position of the knots, for example the speeds and/or accelerations of the needle bar and/or the thread lever.

Instead of an individual reference value, here several reference values may also be saved in the memory of the sewing machine control, which are dependent on one or more parameters, such as length of stitch, width of stitch, or pivotal position of the needle bar. The processing instructions for calculating the guide parameters for the actuator may this way be processed in a simpler and faster fashion. In order to calculate guide parameters the computer may respectively select one or more of these reference values considered optimal under the given conditions.

Reference guide values are predetermined for various combinations of discrete lengths of stitches and widths of stitches in a matrix, which under predeterminable reference conditions at the respective combination of the length and the width of the stitch lead to an optimal knot insertion into a neutral central position. The difference between adjacent discrete lengths and/or widths of stitches, for which the reference guide values can be predetermined, may amount for example to 0.1 mm or range from 0.1 mm to 0.5 mm. The reference guide values are saved in a memory of the sewing machine control and/or the computer.

During the sewing process the computer determines for every sewing stitch to be executed the optimal guide value for the actuator and controls the actuator via this guide value as the guide parameter. Here, the width and the length of the stitch are provided for the sewing stitch to be respectively executed or equivalent values are provided by the control of the sewing machine, and the corresponding guide value is selected or calculated.

The processing specifications of the computer may include additional processing steps, by which dependencies of the knot position from other parameters may additionally be considered. This way, for example a correction value or correction factor is provided, dependent on the pivotal direction of the needle bar in reference to the previous sewing stitch and/or the sewing speed, by which the calculated guide value is being determined more precisely.

Furthermore, the processing instructions for calculating the correction values in order to optimize the guide parameter for the actuator may also consider the temporal development and/or sequence of values of one or more parameters. In particular, one or more values of a parameter may be saved in a memory in a rolling fashion for the present sewing stitch, for one or more directly previous sewing stitches, and/or for one or more directly subsequent sewing stitches. This means, the values are updated for every sewing stitch to be executed. In order to calculate the correction value and/or the optimized guide value for the actuator for the sewing stitch presently to be executed preferably the parameter values of the present sewing stitch, the directly subsequent sewing stitch, and two immediately prior sewing stitches are considered. From these four parameter values a preferably weighed average can be formed, which then is used instead of the present parameter value for calculating optimized guide values for the actuator. Alternatively, correction values may also be calculated for each of the four parameter values, from which then a preferably weighed average is calculated as the correction value for the guide parameter.

The sewing machine preferably comprises a user interface with control elements, by which additional parameters can be selected or adjusted, such as the friction coefficient of a thread, for example. Via the user interface preferably groups of sewing stitches may be defined, for example by predetermining a number of sewing stitches or stitching patterns with a number of sewing stitches which are combined to form a group.

Via the user interface, additional predetermined value may also be stipulated which determine for the sewing stitch the knot position in reference to a corresponding reference position. Preferably the value ranges for these predetermined values from −1 to +1, with the knot position at a value of −1 being at the bottom of the material or near the piercing site of the previous sewing stitch, and with a value of +1 being at the top of the material or near the piercing site of the following sewing stitch. For a predeterminable number of successive sewing stitches, particularly for the sewing stitches of a group, such predetermined values may be set individually, for example by the operating elements adjusting each individual sewing stitch, or automatically determined by way of selecting a preferably scalable curve pattern. Such curve patterns may be saved in a memory of a sewing machine control and/or the processing unit, e.g., as linear arrays with values from −1 and +1 for each stitch of a group of stitches. Preferably, it shall be possible to edit such saved patters and/or to save additional patterns.

During the subsequent sewing process the computer controls the actuator synchronized with the cyclical movement of the needle bar using the successive guide values of the selected and/or active group. Without any additional specifications, this sequence is periodically repeated during the sewing process.

Preferably additional specifications may be provided to the computer via the user interface how to influence the control of the actuator during the sewing process. Such specifications are for example scaling or norming factors, which influence the guide parameters in a group or regulations to sequence several identical or different groups of guide values. This way, during the sewing process, different pattern sequences may be generated by way of varying the knot position.

BRIEF DESCRIPTION OF THE DRAWINGS

In the following, the invention is explained in greater detail based on some figures. Shown are.

DETAILED DESCRIPTION OF THE PREFERRED EMBODIMENTS

Figure 1:
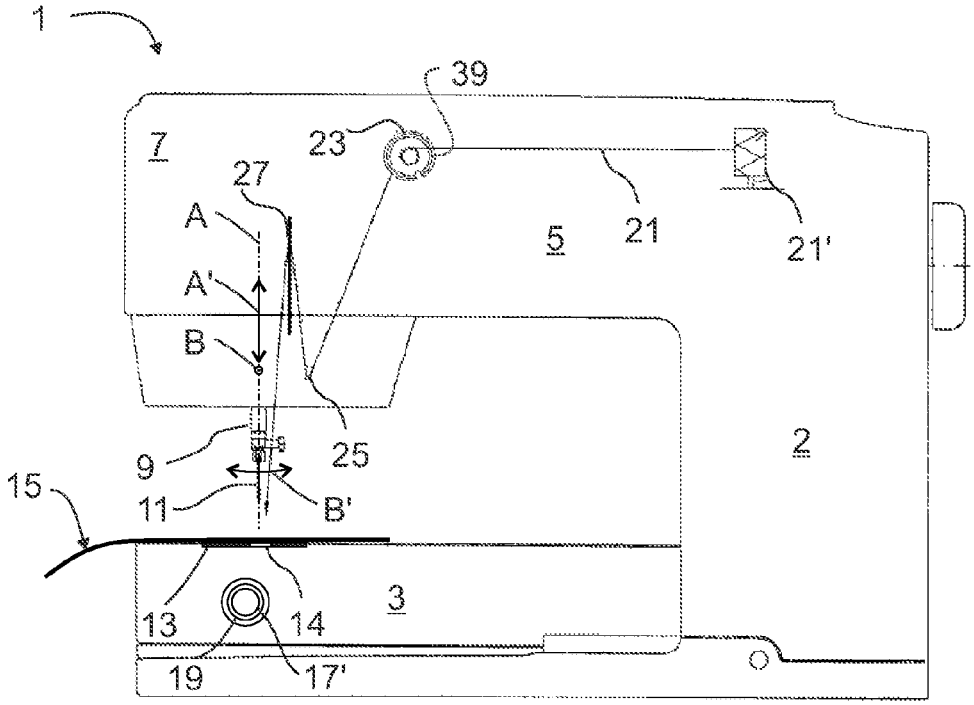
FIG. 1 a sewing machine, shown schematically.

FIG. 1 shows schematically a sewing machine 1 with a frame 2, with the arm bed 3 laterally projecting at the bottom and spaced apart therefrom a top arm 5 at the top. The exterior edge section of the top arm 5 is embodied as a machine head 7. At the bottom of the machine head 7 a needle bar 9 projects with a sewing needle 11 arranged therein in an exchangeable fashion. In order to execute sewing stitches the needle bar 9 is supported such that it can move up and down in the direction of the axis A of the sewing bar (double arrow A') and in order to execute zigzag stitches additionally pivotally about a pivotal axis B perpendicular to the sewing direction N and/or in the longitudinal direction of the top arm 5 in the machine head 7 (double arrow B'). Below the needle bar 9, a needle plate 13 is arranged at the top of the arm bed 3. It comprises an oblong hole 14, through which during the sewing process the bottom section of the sewing needle 11 after piercing a material 15 resting on the needle plate 13 can penetrate the frontal section of the arm bed 3. Here, the supply of bottom thread 17' is stored, spooled in a bobbin case 19.

The spooled supply of upper thread 21' rests on a mandrel at the top arm 5. From this supply area the upper thread 21 is guided successively over a thread tension regulator 23, a deflection means 24, and a thread lever 27 towards the sewing needle 11, and through the eye of said needle 29.

During the sewing process the sewing needle 11 pierces through the material 15 and the oblong hole 14 near the bobbin case 19 into the arm bed 3, where a hook (not shown) engages a loop of the upper thread 21 and guides it around the lower thread 17. In a manner coordinated thereto, the thread lever 27 is lowered and thus releases a sufficient length of the upper thread 21 so that it can unhindered be guided about the bobbin case 19 with the supply of the lower thread 17'. When the needle bar 9 is pulled upwards the thread lever 27 also moves back upwards, coordinated with the motion of the needle bar 9.

Figure 2:
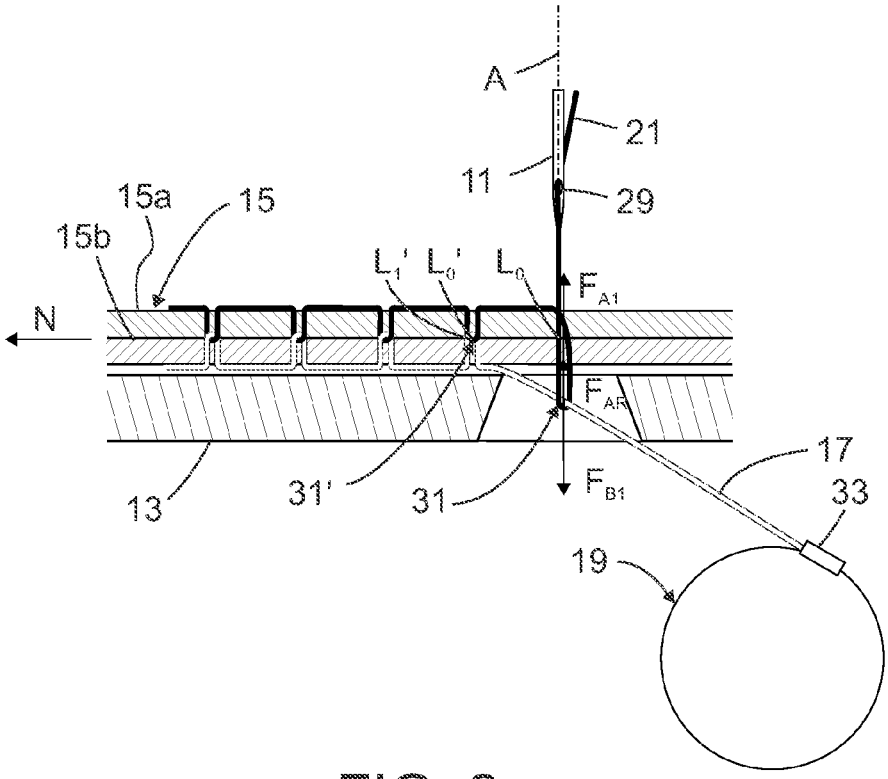
FIG. 2 a schematically shown cross-section of the sewing machine in the area of the needle plate when sewing a material, FIG. 3 a cross-section of the material while sewing with moderate upper thread tension, FIG. 4 a cross-section of the material while sewing with a low upper thread tension, FIG. 5 a cross-section of the material while sewing with a high upper thread tension, FIG. 6 a principle diagram of a sewing machine with elements of a thread tension regulator, and FIG. 7 a material with knots arranged along a curve between the lower thread and the upper thread.

FIG. 2 shows schematically a cross-section of the sewing machine in the area of the arm bed during the sewing process with straight stitches. During the execution of a sewing stitch cycle the upper thread 21 in the last section of the upwards motion of the sewing needle 11 is tightened between the wrapping site with the lower thread 17 and/or the knot 31 and the thread tensioning regulator 23 acting as a friction brake. The lower thread 17 is tightened between the previous knot 31' and a lower thread tension regulator 33, embodied as a friction brake at the outlet from the bobbin case 19. In the area of the knot 31 the lower thread 17 applies a tensile force $F_{A1}$ of the upper thread 21 upon the upper thread 21, at this point opposite the force $F_{B1}$. Due to the forces acting in the area of the knot 31 during the stitch formation upon the upper thread 21 the knot 31 is tightened. Here, the defined knot position $L_1$ shows, in reference to a neutral reference position $L_0$ at a corresponding piercing site of the sewing needle 11, a considerable dependency on the forces and/or the projection of the resulting force $F_{AR}$ during the tightening of the knot 31. The neutral reference position $L_0$ may be predetermined, e.g., by its distance from the needle plate 13. In particular, this neutral reference position $L_0$ may be predetermined in the machine control in a material 15 in the form of a planar formation with two material layers 15*a*, 15*b*, as shown in FIG. 2, as the central position between the two material layers 15*a*, 15*b*. Without moving the material 15 and without any pivotal motion of the needle bar 9 the effective direction of the resulting force $F_{AR}$ is essentially predetermined by the direction of the axis of the needle bar A. In general, the progression of the amount and the direction of the resulting force $F_{AR}$ are dependent on various parameters. They include particularly the following parameters:

- the friction coefficients of the upper thread 21 and the lower thread 17,
- the brake forces applied by the thread tension regulator 23 and the lower thread tension regulator 33 perpendicular to the tensile direction upon the upper thread 21 and/or the lower thread,
- additional friction forces acting upon the threads 17, 19, such as at the eye of the needle 29, the thread lever 27, or the deflection means 25 upon the upper thread 21,
- knot type (rotary or knotting thread connections),
- geometric tensile components and/or directions of the lower thread and the upper thread at the contact sites,
- tensile forces acting upon the upper thread 21 and/or the lower thread 17, which are caused by the transportation of the material 15 in the sewing direction N and/or a pivotal motion B' of the needle bar 9 perpendicular to the sewing direction N and/or by a motion of the needle bar 9 in the direction of the axis of the needle bar A and/or by the motion of the thread lever 27.

Figure 3:
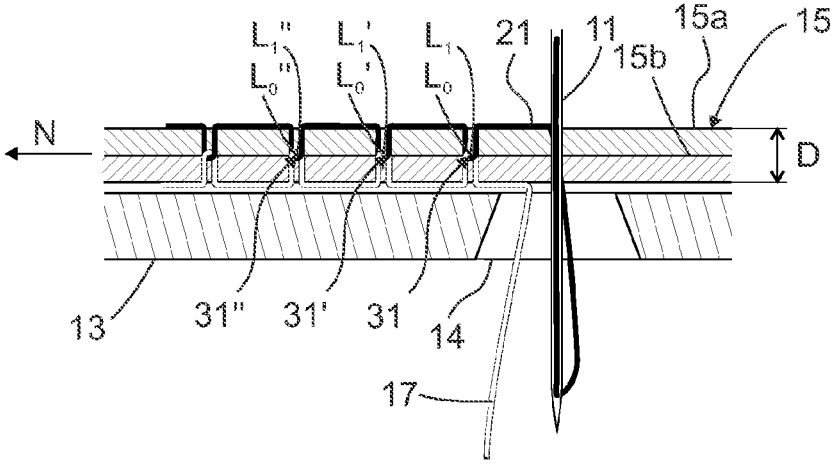
Figure 4:
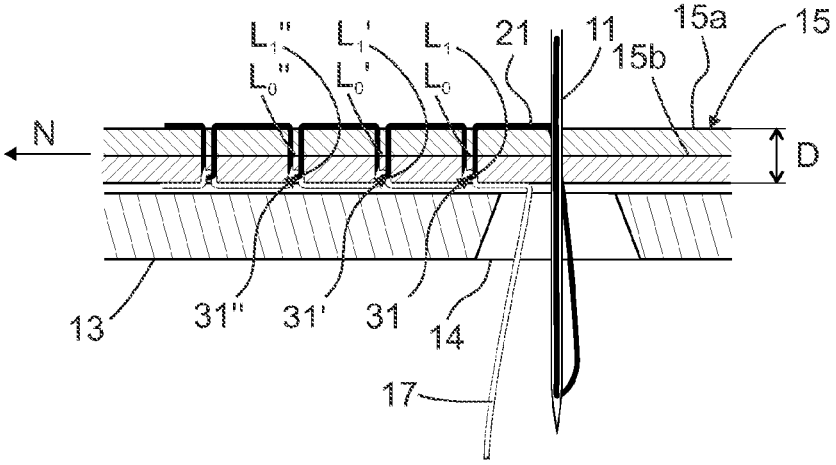
Figure 5:
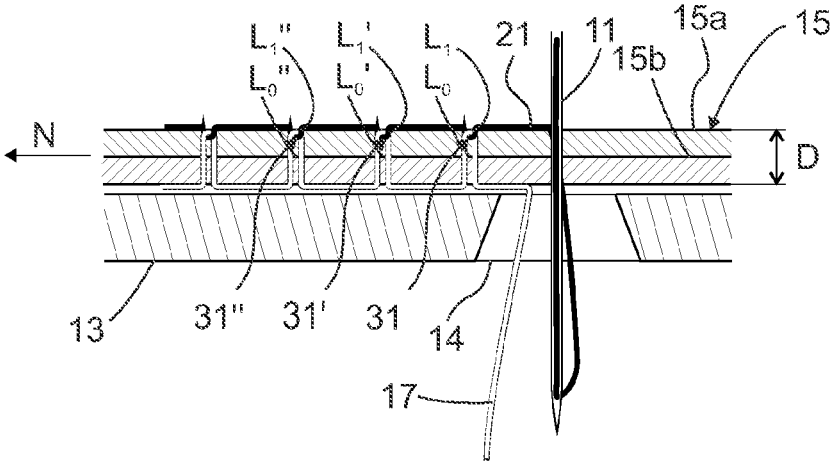

By influencing and/or controlling the braking force of the thread tension regulator 23 and/or the lower thread tension regulator 33, at least during the phase of the knot tightening process, the knot position $L_1$ can be influenced in reference to the predetermined reference position $L_0$ by the thread lever 27 at this piercing site. An increase of the guide value for an actuator 39, by which the actuating value of the thread tension regulator 23 is controlled and the increase in braking force of the thread tension regulator 23 connected thereto causes in the knot 31 an increase of the thread tension and/or the regulating tensile force $F_{AR}$ of the upper thread 21. The final knot position $L_1$ is here displaced towards the top of the material 15. Similarly, the final knot position $L_1$ is displaced at a lower braking force of the thread tension regulator 23 towards the bottom of the material 15. The progression of the resulting force $F_{AR}$ and the final knot position $L_1$ are also dependent on the feed of the material 15 in the sewing direction N and the pivotal motion B' of the needle bar 9, which are implemented to execute the directly subsequent sewing stitch. The FIGS. 3 to 5 show schematically a cross-section of the material 15 when generating a straight seam. The actuating value of the thread tension regulator 23 is determined in the illustration of FIG. 3 such that the final knot position $L_1$ is equivalent to the reference knot position $L_0$. In the example of FIG. 4, based on a weaker braking force of the thread tension regulator 23, the final knot positions $L_1$, $L_1'$, $L_1''$ are shifted downwards compared to the respective reference position $L_0$, $L_0'$, $L_0''$ within the material 15, in the example of FIG. 5 upwards, due to a stronger braking force of the thread tension regulator 23.

In the situations shown in FIGS. 3, 4, and 5 all knots 31 are located within the material 15, which shows a thickness D and/or at a height between 0 and D in reference to the top of the needle plate 13. With an additional increase of the actuating value for the braking force of the thread tension regulator 23 the knots 31 can be pulled completely through the material 15 during the tightening process.

Depending on the respective braking force of the thread tension regulator 23 as well as the feed of the material and the change of the pivotal position of the needle bar 9 for the next sewing stitch to be executed the final knot position L1, L1', L1", with regards to the corresponding reference position L0, L0', L0", shows not only a component in the vertical direction and/or the piercing direction of the sewing needle 11, but also a horizontal component in the direction of the next following piercing site of the sewing needle 11. For zigzag stitches or generally for stitch sequences in which the pivotal position of the needle bar 9 is changed between successive sewing stitches, the knot position $L_1$ at the top of the material 15 can be changed between respectively two successive sewing stitches by the braking force of the thread tension regulator 23, at least while tightening the knot 31. The actuating value for the thread tension regulator 23 is adjusted and/or controlled by the actuator 39, for example by a stepper motor, an actuator motor, or an electromagnet. Similarly, the knot position $L_1$ at the bottom of the material 15 can also be adjusted and/or controlled by the actuator 39. The actuator 39 is controlled by the guide parameter, which is issued by the control 35 of the sewing machine 1. The value of this guide parameter is individually calculated by the computer 37 for every sewing stitch or at least for each group of two or more sewing stitches and provided for addressing the actuator 39.

Figure 6:
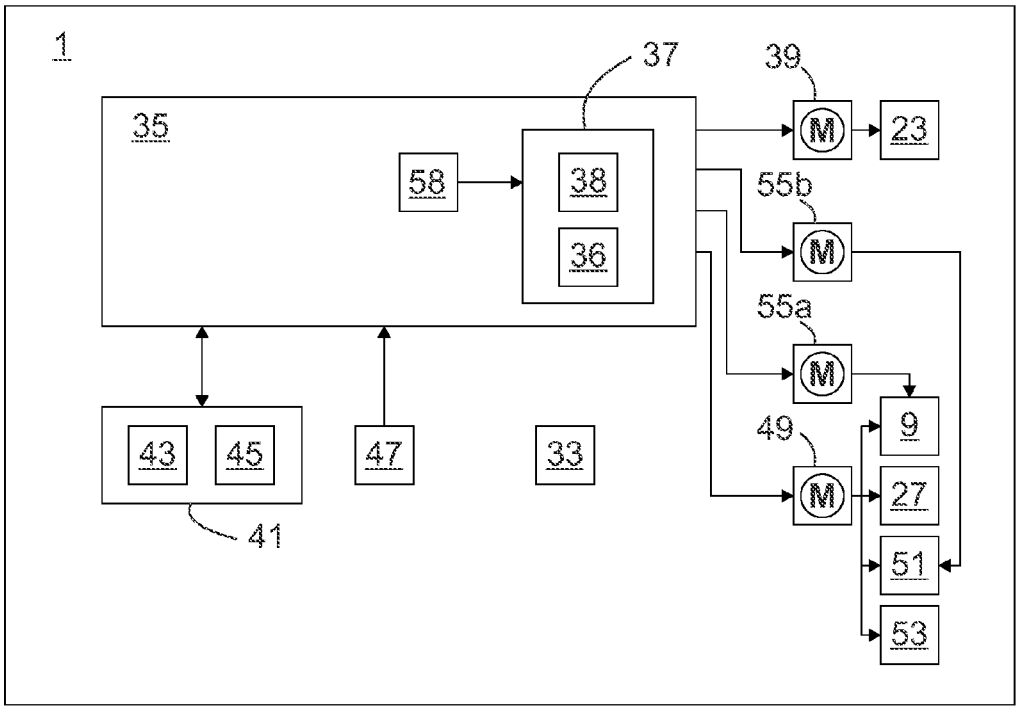

FIG. 6 shows for example a basic circuit diagram of a sewing machine 1 with elements of a thread tension regulator, which can be used for controlling the knot positions $L_1$ when sewing with a sewing machine 1. The control 35 comprises a computer 37 with a program memory 38 and a memory for reference data 36. The sewing machine 1 can be configured and controlled via the user interface 41 using operating elements 43 and preferably showing a graphic display 45. The predetermination of the sewing speed occurs via a foot control 47, which is effectively connected to the control 35.

At the output side the control 35 is effectively connected to the primary engine 49, which serves to drive the cyclical up and down—motion of the needle bar 9 during the sewing process. Other motions, which occur synchronously with the cyclical motion of the needle bar 9, for example the movement of the feeder 51 to feed the material 13 in the sewing direction N, the motion of the grasper 53 to wrap the upper thread 21 about the lower thread 17 during the execution of the sewing stitch, and the pendulum motion of the thread lever 27 are generally also driven by the primary engine. The control 35 may be effectively connected to other actuators for adjusting and/or controlling sewing parameters, particularly an actuator 55*a* to control the pivotal position of the needle bar 9 and an actuator 55*b* for controlling the feeding component of the feeder 51 in the sewing direction N.

The processing specifications are saved in the program memory 38 for calculating the guide values for the actuator 39, by which the pressure and braking force of the thread tension regulator 23 is controlled. At least one reference value for the guide parameter is saved in the reference data memory 36. This reference value is equivalent to a value of the guide parameter by which the actuator 39 must be addressed in order to cause, with predetermined reference conditions during the execution of a sewing stitch, that the actual position $L_1$ of the knot 31 is equivalent to a predetermined reference position $L_0$. This reference value is preferably determined in the initialization process individually for each sewing machine 1 and saved in a non-volatile fashion in the reference memory 36. Alternatively, the reference value may also be predetermined depending on a certain type of sewing machine.

Alternatively, several reference values may be saved in the reference memory 36, each of which for different reference conditions respectively being equivalent to an optimized value of the guide parameter for the actuator 39. The reference conditions may differ by various values for one or more parameters. For example, the reference values for different stitching widths under otherwise identical conditions are saved in the reference memory 36. Similarly, a two-dimensional array of reference values depending on lengths of stitches and widths of stitches can be saved in the reference memory 36. During the sewing process, the actuator 39 is controlled with the particular value saved in the reference memory 36 for the respective combination of length and width of the stitch.

In a similar fashion, reference parameters may be saved in the reference memory 36 for the additional or other combinations of parameters. In particular, the values may also be saved depending on the pivotal direction of the needle bar 9 in reference to the previous sewing stitch and/or values depending on the pivotal position of the needle bar 9 in the reference memory 36. The reference values saved this way represent information carriers, which must be selected as the guide parameter for the actuator 39 depending on one or more parameters in order for the position $L_1$ of the knots 31 being equivalent as closely as possible to a predetermined reference position $L_0$ during the sewing process.

In addition to the saved reference value or values, the computer 37 is provided with values of one or more parameters as the input parameter and/or input parameters 58, influencing the knot position $L_1$ during the sewing process. Such parameters are particularly the pivotal position of the needle bar 9 as well as the material feed in the sewing direction N between the previous sewing stitch and the one now to be executed. Optionally, such values for one or more sewing stitches may be temporarily saved in a memory of the computer 37, and this way considered when calculating the guide parameter. For example, the computer 37 may determine from the difference of the pivotal position of the needle bar 9 between the previous and the present sewing stitch the direction and the amount of the pivotal motion of the needle bar 9. These parameters also represent parameters influencing the knot position $L_1$ during the sewing process.

Values of input parameters 58, which are imported by the computer 37 and further processed, may be already provided within the control 35 or be determined via the user interface 41 by an operator. In particular, one or more of the following actions may be performed via the user interface 41:

- Defining groups of sewing stitches by stipulating the respective number of successive sewing stitches.
- Selecting, editing, and saving sewing patterns with several successive stitch positions.
- Determining a target value for the knot position $L_1$ for each individual sewing stitch within a group of sewing stitches. Preferably here pattern templates saved in the control 35 may be selected, edited, scaled, and saved. The target value for every knot position $L_1$ within a group may be individually altered.
- Adjusting parameter values, such as width and length of the stitch, friction coefficient of the upper thread 21 and/or the lower thread.
- Selecting and/or activating a type of stitching, a stitch pattern, or a group of several successive sewing stitches to be used in the subsequent sewing process.
- Selecting and/or activating a pattern template to predetermine the knot positions during the subsequent sewing process.

Based on the processing instructions saved in the program memory 38 the reference value or values are processed together with at least one parameter influencing the knot position $L_1$ during the sewing process in order to form a guide parameter for the actuator 39.

The processing specifications comprise information regarding the fact how the knot position $L_1$ changes depending on one or more parameter and/or how the guide parameter for the actuator 39 must be adjusted, starting with a saved reference value, depending on one or more parameters, in order for the knot position $L_1$ to be equivalent as good as possible to the reference knot position $L_0$. Such dependencies may be saved in the program memory 38, for example as functions, with the values of the guide parameter preferably being provided for support points, which are distributed evenly over the value range of the respective parameter. If only a few support points are provided, intermediate values may be interpolated.

Optionally, information may be saved for calculating optimized control values for the actuator 39 as reference parameters in the reference memory 36 and/or as processing specifications in the program memory 38.

A desired operating type may be predetermined and/or selected via the user interface 41. In a first operating mode the stitch insertion is optimized in every sewing stitch such that the position of $L_1$ of the knots 31 is equivalent to a neutral central position and/or the reference position $L_0$. In another operating mode the target position $L_1$ for the knots 31 may be predetermined, deviating from the reference position $L_0$. In particular, groups with different sewing stitches may be defined, in which the knot position $L_1$ is adjusted according to selected stipulations individually for every sewing stitch.

Figure 7:
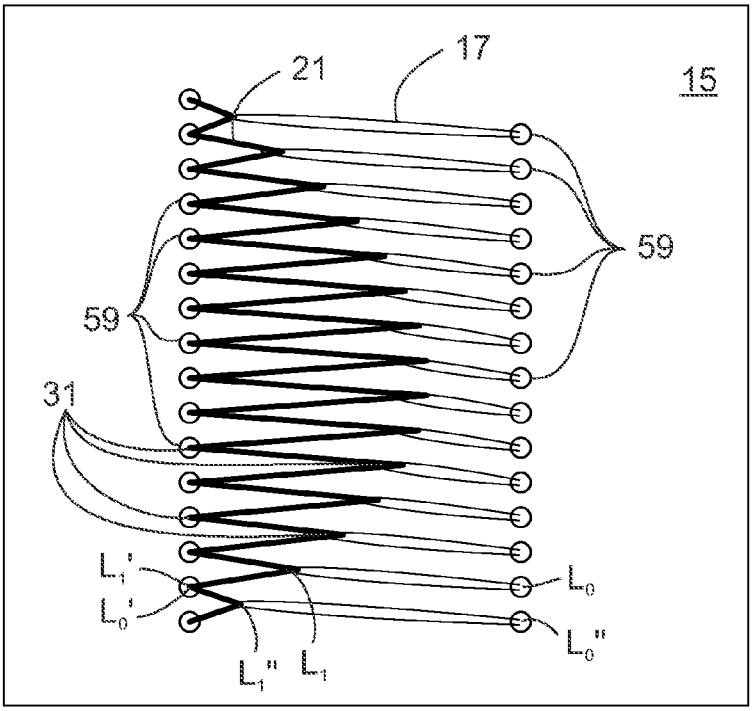

FIG. 7 shows schematically a top view of a material 15, in which the positions $L_1$ of the knots 31 are arranged between the lower thread 17, shown as a thin line, and the upper thread 21, shown as a thicker line, during the sewing process of a zigzag seam along a curve at the top of the material. During the sewing process, the values of the guide parameters calculated for an optimized stitch insertion (positions $L_0''$, $L_0'$, $L_0$, . . . ) are adjusted via correction values for generating the arched curve. In the piercing sites at the left side and/or at every other piercing site the correction value is zero, so that here the actual knot position $L_1'$ is equivalent to the target position and/or the reference position $L_0'$. In the piercing sites at the right side, however, the actual positions $L_1''$, $L_1$ are offset compared to the corresponding reference positions $L_0''$, $L_0$ at the desired position of the top of the material. During the sewing process the actuator 39 was addressed by the control 35 with values of the guide parameter adjusted for each individual sewing stitch.

Of course, the guide parameter may also be varied for the sewing stitches at the left side, the knots 31 here too being arranged displaced towards the top or bottom of the material 15.

Furthermore, the computer 35 may also monitor the reaction times of the actuator 39 and limit the sewing speed predetermined by the foot control 47 such that the reaction times are always shorter than the duration of the stitch cycles.

LEGEND OF THE REFERENCE CHARACTERS

1 Sewing machine
2 Frame
3 Arm bed
5 Upper arm
7 Machine head
9 Needle bar
11 Sewing needle
13 Needle plate
14 Oblong hole
15 (sewing) Material
17 Lower thread
17' Supply of lower thread
19 Bobbin case
21 Upper thread
21' Upper thread supply
23 Thread tension regulator
25 Deflecting means
27 Thread lever
29 Eye of the needle
31 Knot
31*a* Previous knot
33 Lower thread tension regulator
35 Control
36 Reference memory
37 Computer
38 Program memory
41 User interface
43 Operating elements
45 Display device
47 Foot control
49 Primary engine
51 Feeder
53 Grasper
55*a*, 55*b* Actuators
58 Input parameter

The invention claimed is:

1. A device for controlling a position of knots (31) between an upper thread (21) and a lower thread (17) when sewing a material (15) with a sewing machine (1), comprising a thread tension regulator with an actuator (39), the actuator (39) being configured to influence a tensile force $F_{AR}$ applied upon the knot (31) during tightening of the knot (31) of the upper thread (21) and the lower thread (17), a computer (37) to control the actuator that individually predetermines a guide parameter for the actuator (39) for every sewing stitch or for every group of several successive sewing stitches.

2. The device according to claim 1, further comprising a thread tension regulator and a thread lever (27) located successively between a storage site for an upper thread supply (21') and a needle bar (9) in a direction of removal of the upper thread (21), the thread tension regulator (23) acting as a friction brake for the upper thread (21), and the thread lever (27) being adapted to tighten the upper thread (21), and a braking force of the thread tension regulator (23) is at least one of adjustable or controllable by the actuator (39).

3. The device according to claim 2, wherein the computer (37) comprises a program memory (38) and a reference memory (36), with processing stipulations in the program memory (38) for processing being dependent at least on one reference value saved in the reference memory (36) for a guide parameter of the actuator (39) and on values of at least one input parameter (58), which the knot position L1 is dependent upon during a sewing process, in order to form a guide value for addressing the actuator (39).

4. The device according to claim 3, wherein each of the input parameters (58) comprises a value of one of the following parameters, which is effective at a time of formation of the actual sewing stitch or a previous sewing stitch or a subsequent sewing stitch: a pivotal position of the needle bar (9), a width of the stitch, a length of the stitch, an amount of the change of the pivotal position of the needle bar (9) in reference to the pivotal position during the execution of the previous sewing stitch, an direction of the change of the pivotal position of the needle bar (9) in reference to the pivotal position during the execution of the previous sewing stitch, a sewing speed, or control parameter of a foot control (47).

5. The device according to claim 4, wherein saved reference value represents a value for the control parameter of the actuator (39), which under predetermined reference conditions together with a predetermined value of at least one parameter of the input parameters result in a deviation of the knot position L1", L1', L1 during the sewing process being minimal compared to a predetermined reference position L0", L0', L0.

6. The device according to claim 5, wherein for every one of the sewing stitches to be formed a target value is predetermined for the respective knot position L1", L1', L1 compared to the reference position L0", L0', L0.

7. The device according to claim 6, wherein several successive ones of the sewing stitches are combined into groups, and that for every one of the sewing stitches within said group of sewing stitches, a target value is predetermined for the respective knot position L1", L1', L1 compared to the reference position L0", L0', L'.

8. The device according to claim 1, further comprising a device for limiting a maximally permitted sewing speed depending on an adjustment time of the actuator (39).

9. A method for influencing a position of knots (31) between an upper thread (23) and a lower thread (17) when sewing with a sewing machine (1) using a device according to claim 1, comprising the computer (37) determining for every one of the sewing stitches to be executed a value for the guide parameter to control the actuator (39), and coordinating the actuator (39) when executing said sewing stitch with a motion of the needle bar (9), at least during a tightening of the knot (31), with a calculated value of the guide parameter.

* * * * *